United States Patent [19]

Pearce

[11] Patent Number: 4,911,255

[45] Date of Patent: Mar. 27, 1990

[54] MEANS FOR RETAINING ROLLER CUTTERS ON ROTARY DRILL BIT

[75] Inventor: David E. Pearce, Houston, Tex.

[73] Assignee: Reed Tool Company, Houston, Tex.

[21] Appl. No.: 312,459

[22] Filed: Feb. 21, 1989

[51] Int. Cl.[4] ..... E21B 10/22

[52] U.S. Cl. ..... 175/368; 175/369; 175/371; 384/95; 384/96

[58] Field of Search ..... 175/367, 368, 369, 371, 175/372; 384/92, 93, 94, 95, 96

[56] References Cited

U.S. PATENT DOCUMENTS

| | | | |
|---|---|---|---|
| 2,490,151 | 12/1949 | Noble et al. | 384/96 |
| 2,513,634 | 7/1950 | Francis | 175/372 |
| 3,971,600 | 7/1976 | Murdoch et al. | 308/8.2 |
| 4,236,764 | 12/1980 | Galle | 175/369 |
| 4,533,003 | 8/1985 | Bailey et al. | 175/371 |
| 4,538,928 | 9/1985 | Muma | 384/96 |

*Primary Examiner*—Jerome W. Massie
*Assistant Examiner*—Terry L. Melius
*Attorney, Agent, or Firm*—Dodge Bush & Moseley

[57] ABSTRACT

A roller cutter (28) of a drill bit (10) is retained on a journal (24) for rotation by a retainer ring (82) having external screw threads (88) which are threaded onto mating screw threads (108) on the roller cutter (28) for rotation therewith. The retainer ring (82) is mounted within a semicircular groove (68) on the journal (24) and has an inner periphery formed of a smooth arcuate surface contacting the annular groove at a position spaced at least 10° from the entrance opening of the groove thereby to reduce bending stresses exerted against the root (74) of the groove (68).

5 Claims, 2 Drawing Sheets

FIG. 1
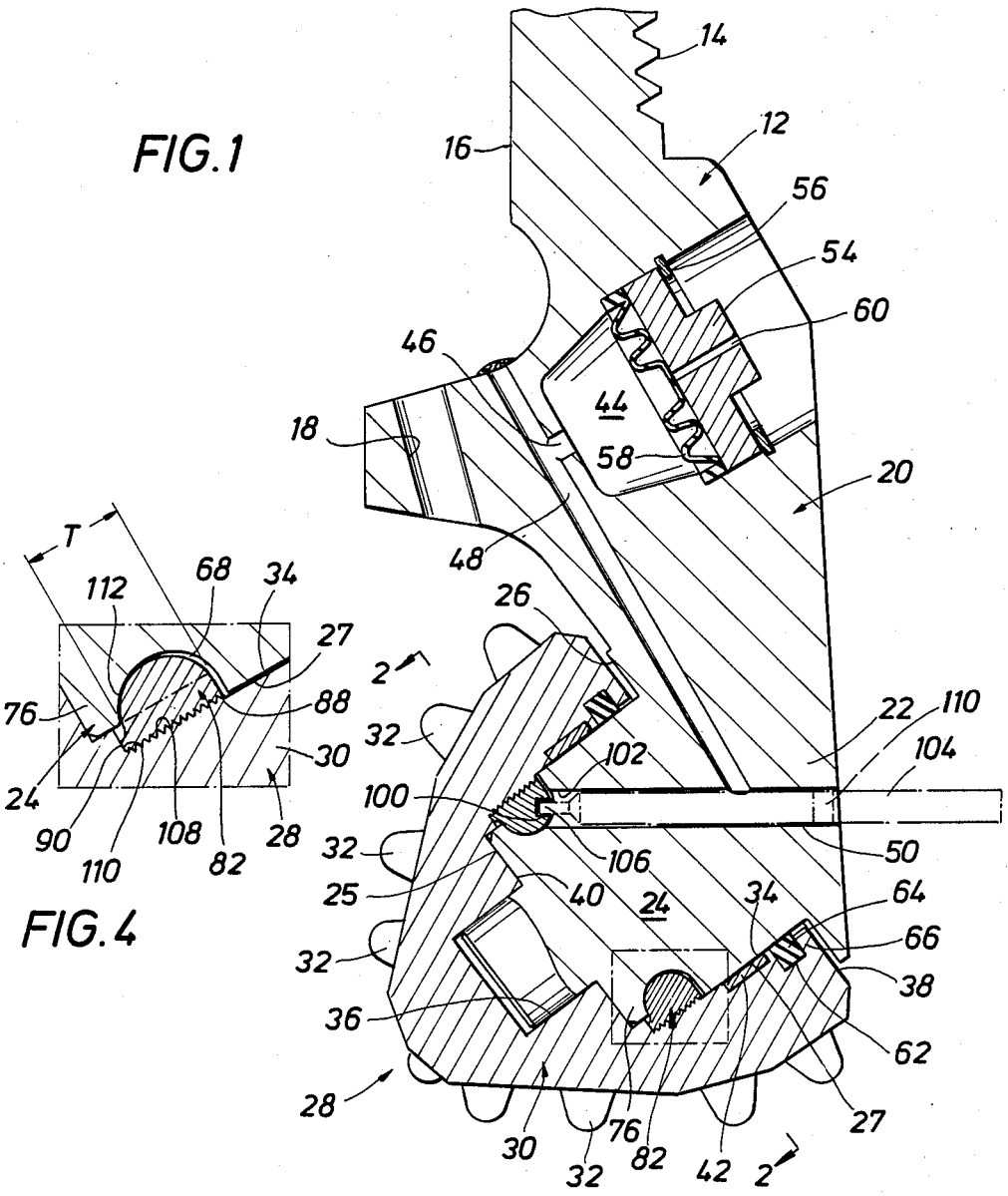
FIG. 4
FIG. 2
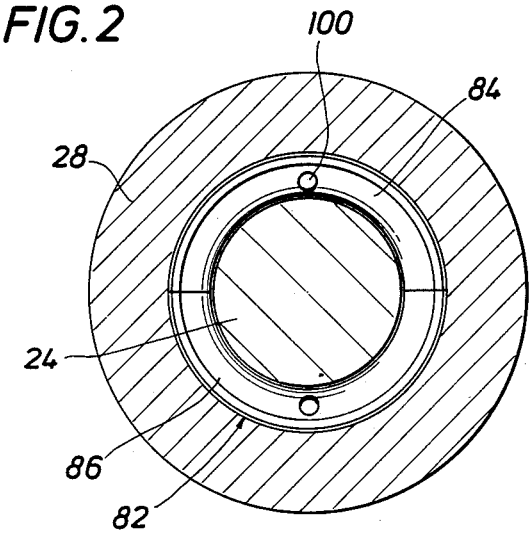
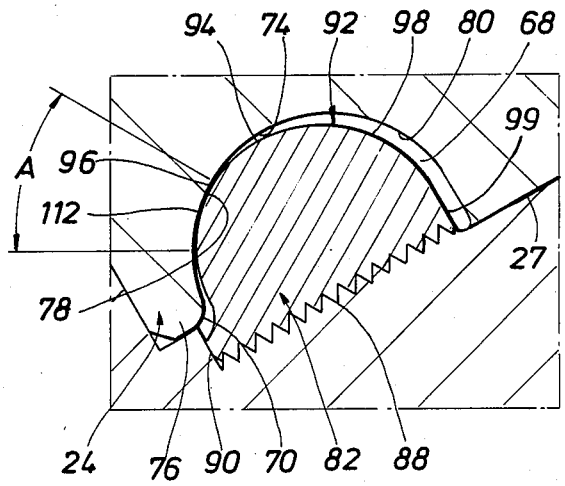
FIG. 3

MEANS FOR RETAINING ROLLER CUTTERS ON ROTARY DRILL BIT

BACKGROUND OF THE INVENTION

This invention relates to roller cutter drill bits and more particularly to improved means for retaining roller cutters on a rotary drill bit.

Heretofore, various means have been employed for retaining roller cutters on a drill bit. For example, ball bearings have been mounted in opposed annular grooves or raceways of the roller cutter and associated cylindrical journal on which the roller cutter is mounted for rotation. A disadvantage of having ball bearings for retainers is that one of the ball bearings or adjacent raceways may fail with metal fragments, or particles entering the friction bearing for damaging such bearing as well as the seal ring thereby resulting in lubricant loss and possible subsequent bearing failure. Also, metal spalling occurs from the small almost point bearing contact of the balls with adjacent surfaces resulting in fatigue and possible chipping of the balls. With substantial wear on the balls, it is possible that the roller cutter may be released from its journal.

Another means for retaining a roller cutter on the cylindrical journal of a drill bit is illustrated in U.S. Pat. No. 4,236,764 dated Dec. 2, 1980 in which a snap ring is positioned within an annular groove of the cylindrical journal and is urged radially outwardly into a registering groove on the roller cutter. However, the snap ring retainer provide a relatively small contact area with the adjacent surfaces. Further, the cross-sectional area of a snap ring is limited in area which may be undesirable, particularly for large diameter roller cutters, and could possibly result in a roller cutter being lost from its journal. Also, the snap ring is oftentimes difficult to assemble requiring fixtures for assembly and possible bearing damage during the assembly process.

Another example of means to retain roller cutters is illustrated in U.S. Pat. No. 3,971,600 dated July 27, 1976 in which a generally rectangular threaded retainer ring is utilized for retaining a roller cutter onto a cylindrical journal of a drill bit. The threaded retainer ring permits a large bearing contact area for retaining the roller cutter and the rectangular cross-sectional area of the threaded retainer ring is relatively large so that the loss of a roller cutter from its bearing journal is minimized. The threaded retainer ring is formed of two semicircular portions mounted in an annular groove in the cylindrical bearing with circumferential external screw threads engaging mating internal screw threads on the roller cutter. The retainer ring is held against rotation as the roller cutter is threaded onto the ring.

SUMMARY OF THE INVENTION

The present invention is an improvement in the threaded retainer ring shown in aforesaid U.S. Pat. No. 3,971,600 for retaining a roller cutter onto a generally cylindrical journal, and comprises a retainer ring having a cross-sectional shape particularly adapted for use in presently existing cylindrical journals for roller cutters which utilize ball bearings for retaining the roller cutter. Such an improved cross-sectional shape of the threaded retainer ring includes external screw threads on its outer circumference and a rounded or arcuate portion along its inner circumferential surface of the ring opposite the external screw threads. The rounded portion bears against a somewhat similar rounded surface defining the annular groove on the cylindrical journal receiving the threaded ring. Such a rounded surface provides a relatively large bearing contact area with the adjacent surface defining the receiving groove to minimize stress concentrations and thereby reduce wear and cracking or fracture of the retainer ring and adjacent groove surfaces including the journal flange at the end of the journal.

An assembly tool is employed to hold the pair of split threaded ring sections against movement during assembly of the roller cutter onto the journal and has a projecting end received within a receiving opening in one of the semicircular ring sections.

It is an object of this invention to provide an improved means for retaining roller cutters on a rotary drill bit utilizing a threaded retainer ring adapted to be mounted in the same journal groove as employed to receive ball bearings.

It is a further object of this invention to provide such an improved threaded retainer ring for retaining roller cutters which has a relatively large bearing contact area with the adjacent groove surfaces for minimizing wear and cracking or fracturing of the retainer ring.

An additional object of this invention is to provide such an improved retainer means in a bearing system for a roller cutter drill bit having a sealed lubrication system and an elastomeric seal between the journal and roller cutter.

Additional objects, features and advantages of the invention will become more apparent from the following specification and drawings.

BRIEF DESCRIPTION OF THE DRAWINGS

FIG. 1 is a longitudinal sectional view of a portion of a roller cutter drill bit showing a roller cutter mounted on a journal for rotation and retained on the journal by retainer means comprising the present invention;

FIG. 2 is a cross section taken generally along the line 2—2 of FIG. 1 and showing the retainer ring of the present invention for retaining the roller cutter on the journal;

FIG. 3 is an enlarged sectional view of the roller cutter retaining means comprising the present invention showing the retainer ring secured to the cutter and mounted within a semicircular groove on the journal;

FIG. 4 is an enlarged section similar to FIG. 3 but showing the retainer ring removed from the roller cutter;

DETAILED DESCRIPTION OF THE INVENTION

Figure 5:
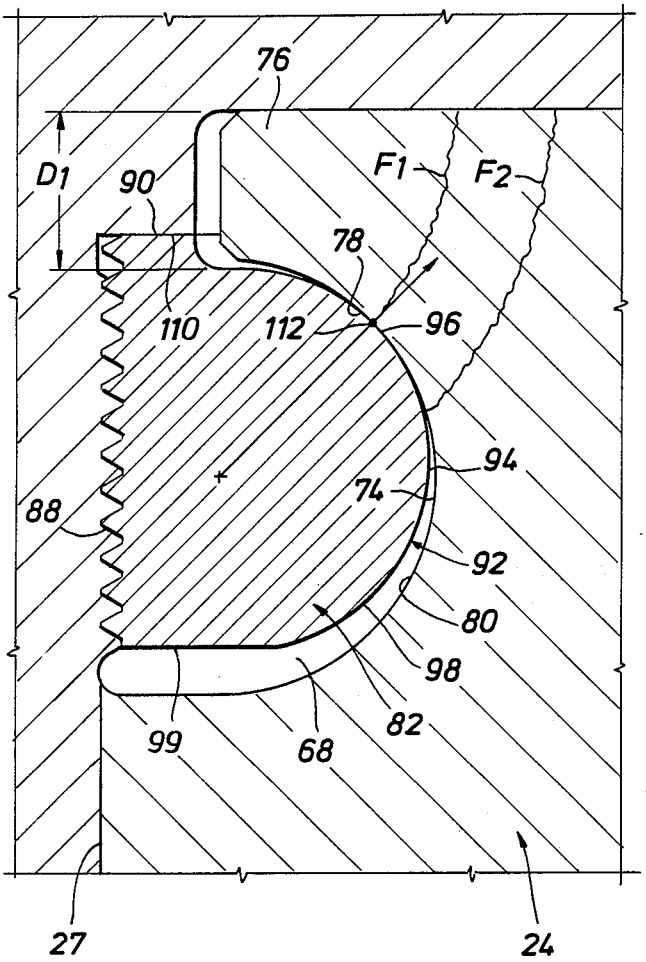
FIG. 5 is an enlarged section of the retainer means similar to FIG. 3 and partly diagrammatic for a comparison with a prior art retainer ring.

Referring now to the drawings for a better understanding of this invention, a rotary drill bit is shown partially at 10 at FIG. 1 including a body 12 having threads 14 at its upper end adapted to be connected to a drill string (not shown) for rotation and for supply of drilling fluid through bore 16 and opening 18 for discharge against the formation to be bored or cut by drill bit 10.

Drill bit 10 is a triple cone rotary drill bit and body 12 is formed of three contiguous legs or segments 20 welded together for forming body 12. Each leg 20 has a free extending end 22 with a generally cylindrical journal or spindle 24 extending outwardly from leg 22 and defining an annular thrust bearing 25 on the extending outer end of journal 24. A planar generally annular surface 26 is provided on leg 22 at the base of journal 24. A roller cutter generally indicated at 28 has a conically shaped body 30 with cutting elements 32 projecting therefrom for engaging the formation to be cut. Cutter body 30 has a central bore 34 therein including a small diameter end bore portion 36. A rear planar annular surface shown at 38 is in spaced opposed relation to planar annular surface 26 on leg 22. Central bore 34 defines an inner annular bearing area 40 in bearing contact with annular thrust bearing 25 on journal 24. A bushing 42 is mounted between journal 24 and roller cutter body 30.

For lubricating the bearing areas, a lubricant reservoir 44 is provided, in bit body 12 having an opening 46 leading to lubricant channels 48 and 50 for providing lubricant to the bearing areas. Reservoir 44 has an end plug or closure 54 secured by a snap ring 56. A flexible diaphragm 58 is positioned in reservoir 44 and opening 60 in plug 54 is in communication with the exterior of drill bit 10 so that the pressure in the lubricant adjacent the bearing areas is in balance with the drilling fluid pressure outside drill bit 10. Thus, diaphragm 58 acts as a pressure compensator between the lubricant pressure and the drilling fluid pressure.

For sealing the lubricant in the bearing areas from the drilling fluid in order to prevent detritus or other foreign matter from entering the bearing areas, an annular groove 62 in roller cutter body 30 is provided and a resilient seal 64 is mounted within annular groove 62. A flange 66 formed by groove 62 aids in limiting contact of resilient seal 64 with the drilling fluid and formation cuttings entrained therein.

Referring now to FIGS. 3 and 4, the retaining means for retaining roller cutter 28 onto journal 24 and comprising the invention is particularly illustrated. Annular groove 68 of a semicircular cross section is shown in journal 24 and is generally identical to the standard groove as presently utilized by ball bearing members for retaining a roller cutter on a journal as well known. The entrance to groove 68 is defined relating to the extending outer end of journal 24 by an outer beveled edge 70 and an inner beveled edge 72 with the root or apex of groove 68 shown at 74. Groove 68 is defined by a smooth arcuate surface extending between outer and inner edges 70,72 through root 74 and struck from a generally constant radius. A flange 76 is formed on journal 24 adjacent outer edge 70. The smooth arcuate contour or surface defining groove 68 has an outer quadrant shown at 78 extending between outer edge 70 and root 74, and an inner quadrant 80 extending from inner edge 72 to root 74. Each quadrant 78,80 includes around 90° of arcuate surface.

Mounted in groove 68 is a thrust bearing ring generally indicated at 82 composed of two generally identical half sections 84,86. The outer circumference or periphery of thrust ring 82 has screw threads 88 thereon with an outer shoulder 90 formed at the outer end of screw threads 88. The inner periphery of ring 82 is formed of a smooth arcuate surface or contour generally similar to the contour or arcuate surface of groove 68 but preferably having a smaller radius as illustrated at 92. Outer peripheral surface 92 is of a generally semicircular contour or shape having an apex 94, an outer quadrant 96 between apex 94 and outer shoulder 90, and an inner quadrant 98 between apex 94 and planar end surface 99. A circular opening is formed at 100 in thrust bearing 82.

A bore 102 is formed in leg 22 and journal 24 in communication with groove 68 and a suitable tool shown at 104 has an extending prong 106 adapted to fit within opening 100 to prevent movement of thrust ring 82 during assembly of roller cutter 28 on journal 24. After assembly of roller cutter 28, tool 104 is removed from bore 102 and a plug 110 is placed in the end of bore 102 to prevent any lubricant loss.

Central bore 34 of roller cutter 28 has a portion thereof defined by internal screw threads 108 which terminate at a shoulder 110 as shown particularly in FIG. 3. For assembly of roller cutter 28 onto journal 24, half sections 84 and 86 of thrust bearing ring 82 are positioned within groove 68. Then, assembly tool 104 is placed within bore 102 and prong 106 engages one of the openings 100 to hold ring 82 against rotation. Next, roller cutter 28 is threaded onto threads 88 of ring 82 with shoulders 90 and 110 in abutting relation for accurately positioning roller cutter 28 on journal 24.

As shown in FIG. 3, inner quadrant 98 of ring 82 is spaced from inner quadrant 80 of groove 68 and is maintained in such spaced relationship by contact of thrust bearing 25 against bearing area 40.

It is preferred that the mating threads 88 and 108 on ring 82 and roller cutter 28 be right hand threads so that they will not loosen as the roller cutter 28 turns during drilling in the normal clockwise drill bit rotation. Suitable thread locking material may be used, if desired, to prevent loosening of roller cutter 28 on thrust bearing ring 82.

In operation, retainer ring 82 engages the surface defining groove 68 along the outer quadrant surface 78 preferably along a contact line shown at 112 located around a 45° arc from edge 70 or midway along quadrant 78 between outer edge 70 and root 74 of groove 68.

By contacting the arcuate surface defining groove 68 at such a location, the bending stress at root 74 is reduced as compared with the bending stress of root 74 if the bearing line or surface is adjacent outer edge 70 since the moment arm is substantially reduced and as well known, the shorter the moment arm, the lesser the bending stress. It is well known, particularly when flange 24 is of a relatively small thickness, that failures sometime occur with the cracking of journal 24 at root 74 which may result in the cracking of flange 76 and possible loss of the roller cutter from the journal. The closer the bearing area is to the root of the groove, the lesser the moment arm and thereby the less the bending stress exerted at root 74. An optimum range of bearing contact along quadrant 78 is between 30° and 60° as shown at A in FIG. 3. However, under certain conditions, a range of bearinq contact with surface 78 between 10° and 80° along the outer quadrant would function satisfactory. Thus, a spacing of the bearing contact area from outer edge 70 of at least 10° of the arcuate surface is believed to be necessary in order to obtain satisfactory results from a substantial reduction of the bending stress exerted for reducing the possibility of cracking or chipping of flange 76.

Figure 6:
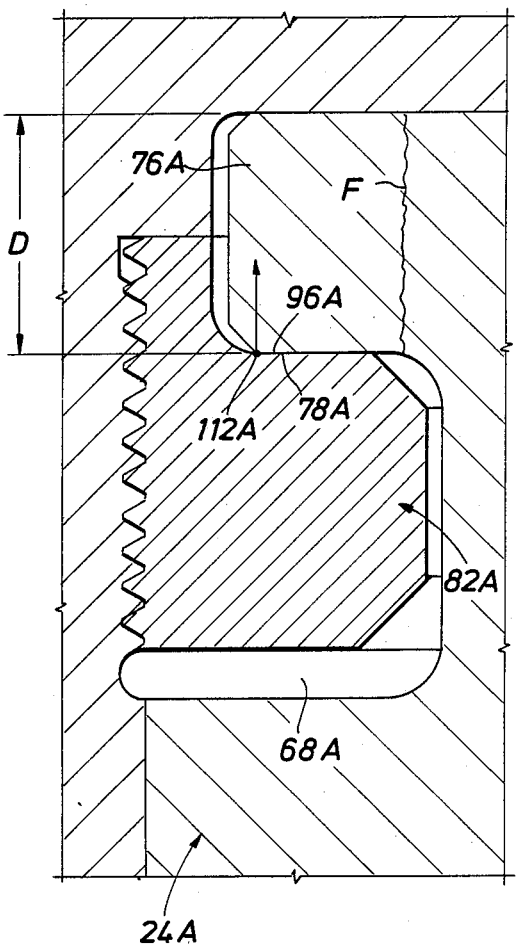
FIG.6 (PRIOR ART)
FIG. 6 is an enlarged section of a prior art retainer means utilizing a rectangular threaded retainer ring for a comparison with the retainer means of FIG. 5.

Referring now particularly to FIGS. 5 and 6, a comparison is made between the retainer ring comprising the present invention as shown in FIG. 5 and the prior art retainer ring as shown in FIG. 6. As shown in FIG. 6, the prior art retainer ring 82A is received within a groove 68A of a generally rectangular cross-section positioned inwardly of flange 76A on journal 24A. The thickness of flange 76A is shown at D and is relatively large. The outer surface of ring 82A shown at 96A bears against surface 78A defining groove 68A generally along surface 78A, or concentrated at point 112A particularly if there is misalignment of the roller cutter. Thus, a relatively large bending stress is provided particularly at the outer corner of groove 68A which generates a relatively large bending stress against flange 76A and sometimes results in a fracture of flange 76A along fracture line F unless flange 76A is of a relatively large thickness. A large thickness flange 76A utilizes valuable space.

In comparison and referring to FIG. 5, a small thickness flange 76 having a thickness shown at D1 may be utilized with the present invention as bearing or retainer ring 82 acting along line 112 provide a relatively short moment arm and flange 76 progressively increases in thickness inwardly from its outer circumferential surface. Flange 76 would probably crack or fracture along fracture lines F1 or F2 in the event of failure and it is noted that the length of such fracture lines is substantially the same or greater then the length of fracture line F of the prior art arrangement of FIG. 5 even though flange 76 is of a small thickness D1. Also, in the event of failure of bearing ring 82 along fracture line F1, a substantial portion of bearing ring 82 would have to be worn away before the roller cutter falls off its journal 24.

Groove 68 has been illustrated as being a standard groove presently used with ball bearings for retaining roller cutters on journals and the present invention may be utilized with such a standard journal design for ball bearings. Another area of failure which results in the loss of a roller cutter from a journal is in the wearing of the retainer means, such as a snap ring or the like, particularly after seal failure or loss of lubricant. Since retainer ring 82 has a contour generally similar to the contour of groove 68, a relatively large thickness of ring 82 must be worn through before roller cutter 28 is lost from journal 24. As shown in FIG. 3, the thickness shown at T must be worn away before ring 82 will release roller cutter 28. Thickness T is only slightly less than the width of the entire groove 68 between edges 70 and 72.

As various changes could be made in the constructions illustrated without departing from the scope of the invention, it is intended that all matter contained in the above description or shown in the accompanying drawings shall be interpreted as illustrative and not in a limiting sense.

What is claimed is:

1. A rotary drill bit comprising:

a bit body having a depending leg and a generally cylindrical journal extending therefrom with an annular groove therein of a substantially semicircular shape in cross section to define relative to the outer end of said journal spaced outer and inner edges at the entrance to the groove, said groove having a root at its deepest point and defining an outer quadrant on one side of said root beginning at said outer edge and an inner quadrant on the opposite side of said root beginning at said inner edge;

a conically shaped roller cutter having a body with a central bore therein for receiving said journal and including internal screw threads defining a portion of said central bore, said journal having a thrust bearing surface thereon contacting said roller cutter for limiting axial movement of said roller cutter toward said leg;

a retainer ring mounted within said annular groove and having external screw threads along its outer periphery in threaded engagement with said internal screw threads on said roller cutter for rotation with said roller cutter relative to said journal; and said retainer ring having a smooth arcuate surface along its inner periphery in bearing contact with said outer quadrant segment generally along a line spaced at least 10° from said outer edge of said groove with said smooth arcuate surface being formed of a radius less than the radius forming the adjacent semicircular shape of said groove for minimizing bending stresses exerted at the root of said groove, said retainer ring being spaced from said inner quadrant segment by contact of said roller cutter against said thrust bearing surface.

2. A rotary drill bit as set forth in claim 1 wherein said groove is formed of a constant radius and said retainer ring has a generally semicircular outer periphery formed of a smooth arcuate surface.

3. A rotary drill bit as set forth in claim 1 wherein said journal has an outer flange formed adjacent said outer edge defining said groove, said outer flange being of a relatively small thickness.

4. A rotary drill bit comprising:

a bit body having a depending leg and a generally cylindrical journal extending therefrom with an outer annular groove;

a conically shaped roller cutter having a body with a central bore therein for receiving said journal, said journal having a thrust bearing surface thereon in bearing contact with said roller cutter to limit axial movement of said roller cutter toward said leg;

a retainer ring mounted within said annular groove and removably connected to said roller cutter for rotation with said roller cutter on said journal;

said annular groove being generally adjacent the extending end of said generally cylindrical journal and being of a generally semicircular contour and defining an annular flange adjacent the end of said journal, said generally semicircular contour defining a root at the deepest point of the groove to form on opposed sides of the root an outer quadrant segment adjacent said flange and an inner quadrant segment remote from said flange;

said retainer ring having a rounded surface along its inner periphery in bearing contact with said outer quadrant segment at a position at least 10° from the beginning of said groove defined by its outer edge with said rounded surface being formed of a radius less than the radius forming the semicircular contour of said groove thereby to space said bearing area from the outer edge of said groove for reducing bending stresses exerted thereby at the root of said groove, said retainer ring being spaced from said inner quadrant segment by bearing contact of said roller cutter against said thrust bearing surface.

5. A rotary drill bit as set forth in claim 4 wherein said bearing ring has external screw threads on its outer periphery and said roller cutter has mating internal screw threads formed along a portion of said internal bore for connecting said ring to said cutter for rotation therewith.

* * * * *